United States Patent [19]

Powers

[11] Patent Number: 4,696,594

[45] Date of Patent: Sep. 29, 1987

[54] COSMETIC PENCIL HAVING ADVANCEABLE COSMETIC MASS

[76] Inventor: Ronald J. Powers, 109 S. Poinsettia Ave., Manhattan Beach, Calif. 90266

[21] Appl. No.: 776,390

[22] Filed: Sep. 16, 1985

[51] Int. Cl.[4] ..... A45D 40/02; A45D 40/20

[52] U.S. Cl. ..... 401/65; 401/53; 401/103; 401/171; 401/176

[58] Field of Search ..... 401/65, 67, 68, 74–79, 401/116, 117, 171, 172, 182, 176, 53, 55, 103

[56] References Cited

U.S. PATENT DOCUMENTS

| | | | |
|---|---|---|---|
| 1,447,677 | 3/1923 | Lindberg | 401/67 |
| 1,447,678 | 3/1923 | Lindberg | 401/67 |
| 1,666,405 | 4/1928 | Caldwell et al. | 401/65 |
| 1,729,786 | 10/1929 | Lindberg | 401/53 |
| 1,729,791 | 10/1929 | Morris | 401/53 |
| 1,729,814 | 10/1929 | Becker | 401/67 X |
| 2,563,943 | 8/1951 | Kruck | 401/75 |
| 2,911,948 | 11/1959 | Spector | 401/67 X |
| 3,256,980 | 6/1966 | Bau | 401/75 |
| 4,490,061 | 12/1984 | Katz | 401/65 X |

FOREIGN PATENT DOCUMENTS

| | | | |
|---|---|---|---|
| 436912 | 5/1924 | Fed. Rep. of Germany | 401/65 |
| 807367 | 4/1951 | Fed. Rep. of Germany | 401/65 |
| 12950 | of 1907 | United Kingdom | 401/67 |
| 945898 | 1/1964 | United Kingdom | 401/103 |

*Primary Examiner*—Steven A. Bratlie

*Attorney, Agent, or Firm*—Edgar W. Averill, Jr.

[57] ABSTRACT

A cosmetic pencil containing a cosmetic mass in a thin pencil lead-like configuration. The pencil has a cosmetic mass or crayon-containing sheath and the cosmetic mass may be metered from the pencil by moving a gripping disk inwardly with respect to the sheath. This is done by turning the sheath, by moving it inwardly with respect to the pencil or by pushing a button at the back of the pencil. The mass is forced out of the sheath in a small, metered amount. The cosmetic mass may be cast in the sheath.

17 Claims, 9 Drawing Figures

COSMETIC PENCIL HAVING ADVANCEABLE COSMETIC MASS

BACKGROUND OF THE INVENTION

The field of the invention is writing or marking instruments and the invention relates more particularly to a cosmetic pencil having means for advancing the cosmetic mass outwardly therefrom.

Instruments for holding and ejecting writing or marking materials have been known for many years with mechanical pencils being, perhaps, the most widely used application of such technology. The use of a gripping disk positioned about a central push rod is likewise well known, and one early example is shown in U.S. Pat. No. 1,447,677 to Lindberg which utilizes a pair of disks which have a central opening which will grip a central push rod when the disk is moved from a right angle with respect to the push rod.

Makeup sticks have been inserted in pencil-like devices for many years. One early example being U.S. Pat. No. 2,142,312 to Heinz. Typically, however, most cosmetic pencils in common use are either provided in a wooden pencil sheath which is sharpened in the manner of the common lead pencil or with sharpenable crayons which are advanced with a threaded sleeve surrounding a threaded central push member such as shown in U.S. Pat. No. 3,768,915 to Spatz. It is important for many cosmetic applications that the cosmetic pencil have a relatively fine point so that the cosmetic can be applied to the exact area or line desired. For that reason, many cosmetic pencils provide some sharpening means such as shown in the above-referred Spatz patent. A major problem with many cosmetic pencils such as those used for eyeliner, is the lack of structural integrity of the cosmetic mass. The softness of the mass creates a far greater problem than the common rigid lead of a mechanical pencil and some form of sheathing is generally necessary to strengthen the mass. A marking element showing a sheath is disclosed in U.S. Pat. No. Re. 25,741 to Smith. It is desirable, however, that the marking element be very thin so that no sharpening is necessary and efforts to support and control a soft mass in a thin crayon remains an unfilled need. Attempts to provide an advanceable mass usually results in customer dissatisfaction because of the user's tendency to advance the mass too far causing the tip to break off.

SUMMARY OF THE INVENTION

It is an object of the present invention to provide a cosmetic pencil which can support and advance a thin, soft cosmetic mass a small metered amount.

The present invention is for a pencil which has an elongated lower cylindrical stop element assembly having a hollow opening which has a disk stop element adjacent the opening. A forward barrel is affixed to the elongated lower cylindrical stop element assembly, and the forward barrel has a hollow opening. The stop element assembly and the forward barrel are connected together to form a forward barrel assembly. A sheath and push rod member having an elongated, hollow sheath with an applicator end and an inner end is held by the forward barrel assembly. kThis member has an axial cylindrical bore which is at least partially filled with a cosmetic bore which is at least partially filled with a cosmetic mass and also has a push rod member having its inner terminus position within the bore and having its outer terminus extending outwardly passed the inner end of the sheath. The sheath and push rod member has a shoulder on its outer surface near the inner end thereof. This member is maintained in the forward barrel so that the applicator end of the sheath is extendable outwardly of the barrel and the push rod extends into the hollow opening of the forward barrel assembly which, in turn, has an inner shoulder which surrounds the sheath and push rod member and stops the forward movement of the shoulder of the sheath and push rod member. A gripping disk having a central opening which has an inside diameter which is slightly larger than the outside diameter of the push rod member is positioned about the push rod member, and the disk fits within the forward barrel assembly and abuts the disk stop element of the lower cylindrical stop element assembly near its outer edge. Spring means urge the shoulder of the sheath toward the shoulder of the forward barrel assembly. Thus, when the sheath and disk stop element are moved inwardly with respect to each other, the gripping disk abuts the disk stop element of the lower cylindrical stop element assembly and causes it to grip the push rod so that the cosmetic mass is moved outwardly of the sheath at its applicator end. The movement of the sheath with respect to the forward barrel assembly can be carried out in several ways. One such way is the use of a cam surface and cam following surface which causes an oscillating inward and outward movement when the sheath is rotated with respect to the forward barrel assembly. Another method utilizes a push button which may be combined with a second spring to cause first a movement of the sheath assembly outside of the forward barrel and with further pushing a small metered movement of the cosmetic mass from within the sheath. A novel spring member combines the biasing action necessary and operates by the use of one or more fingers which are bent inwardly by a frustro-conical opening in the bottom of the sheath.

DESCRIPTION OF THE PREFERRED EMBODIMENTS

Figure 1:
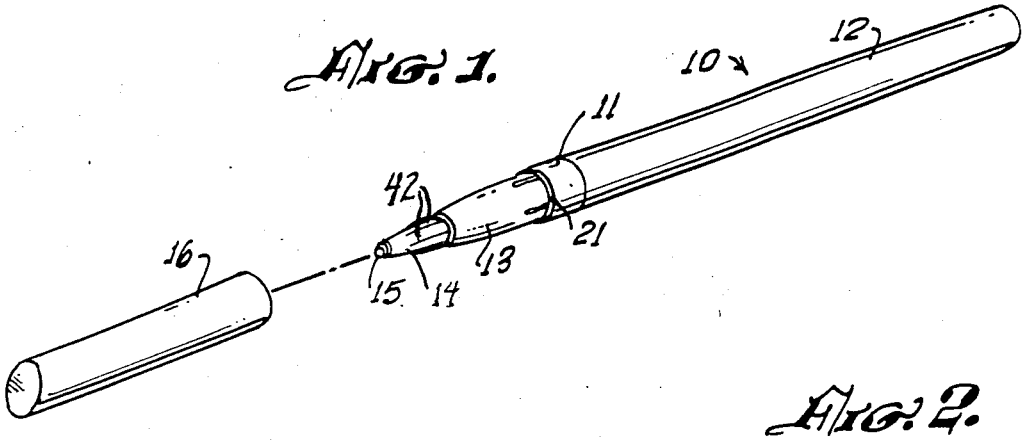
FIG. 1 is a perspective view of the exterior of the cosmetic pencil of the present invention.
Figure 2:
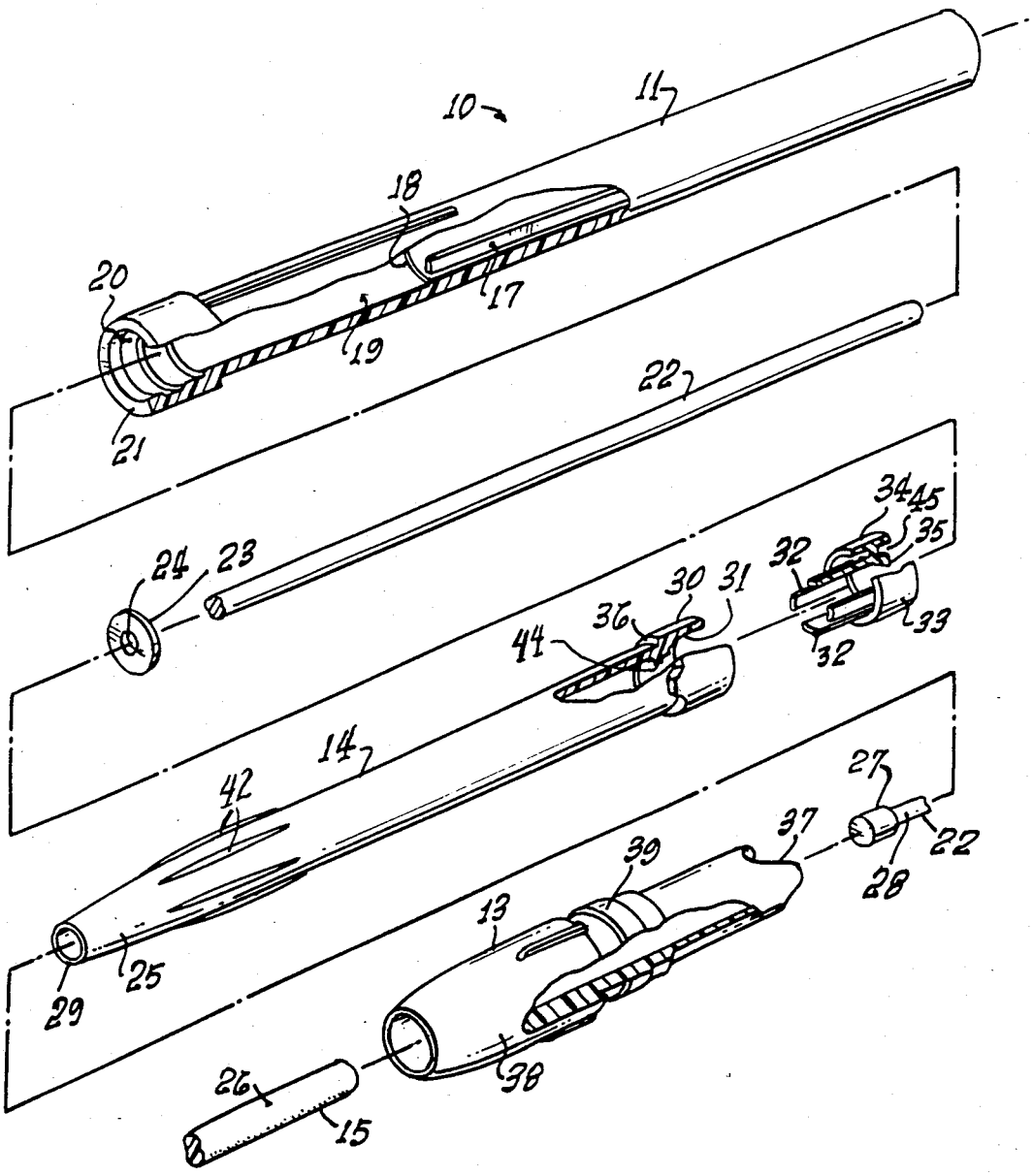
FIG. 2 is an exploded view, partly in cross-section of the cosmetic pencil of FIG. 1.

The cosmetic pencil of the present invention is shown in perspective view in FIG. 1 and indicated generally by reference character 10. kThe pencil has a lower barrel 11 which may be covered for appearance sake with a cover tube 12. Pencil 10 also has a forward barrel 13, a sheath 14 and a cosmetic mass 15. A cap 16 protects the cosmetic mass in a conventional manner. The details of construction of pencil 10 are shown best in exploded view in FIG. 2 where lower barrel 11 is partly broken away and shows a disk stop element 17 along the inner surface thereof. Preferably, disk stop element 17 is an integral part of lower barrel 11 but, of course, it could comprise a separate element inserted into the interior of barrel 11 as shown in Figures 6 through 9. A shoulder 18 is also formed along the interior surface 19 of barrel 11. Shoulder 18 will be referred to herein as a second holding tube inner shoulder. A locking recess 20 is formed near the open end 21 lower of barrel 11 which serves to hold the forward barrel 13 as described below.

A push rod 22, preferably formed of brass, steel or other relatively strong material, is surrounded by a gripping disk 23 which has a central opening 24 which has an inside diameter larger than the outside diameter of push rod 22. As with the prior art mechanical pencil, when disk 23 is cocked with respect to push rod 22, the central opening 24 binds or grips the push rod preventing relative movement in one direction.

A sheath member 25 contains a cosmetic mass or crayon 26 which may be cast therein. A push head cylinder 27 is placed within sheath member 25 and the inner terminus 28 of push rod 22 contacts push head cylinder 27. KThis arrangement is shown best in FIG. 3 of the drawings. The combined sheath and push rod will be referred to herein as the sheath and push rod member.

Figure 3:
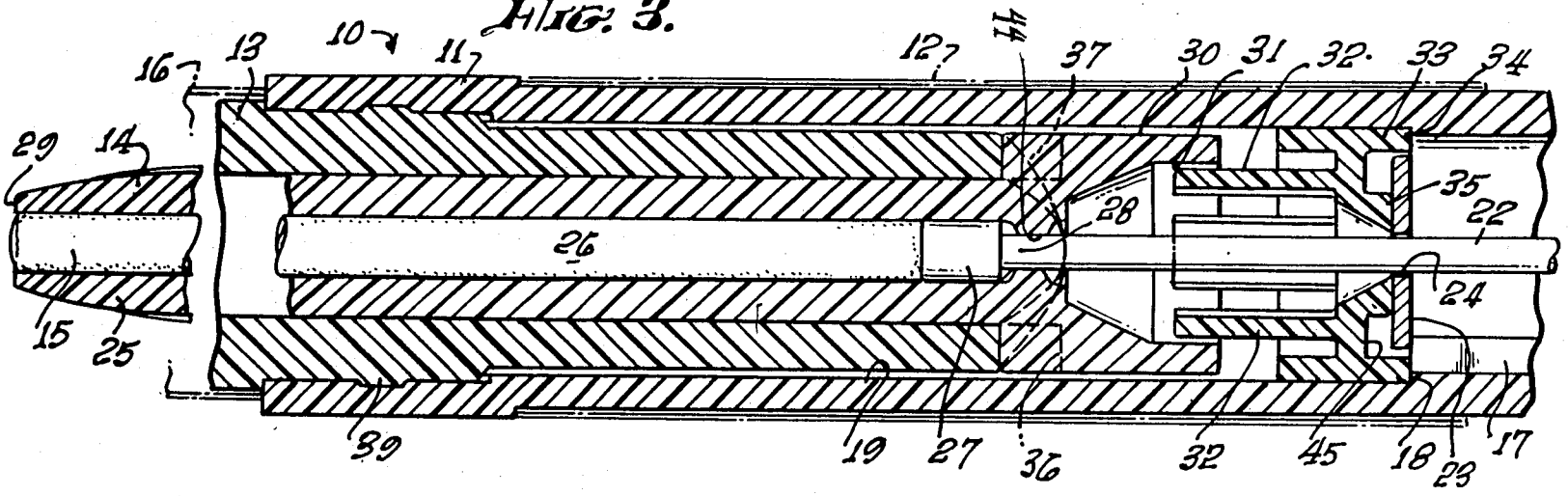
FIG. 3 is an enlarged cross-sectional view, partly broken away of the upper part of the cosmetic pencil of FIG. 1.

Sheath member 25 has an applicator end 29 and an inner end 30. The inner end has a frustro-conical surface 31 shown both in FIG. 2 and in FIGS. 3 and 4. Frustro-conical surface 31 contacts a plurality of fingers 32 which are an integral part of spring element 33. A gripping disk support element and spring element 33 has an outer ring 34 which abuts shoulder 18 of lower barrel 11. A gripping disk support element and spring element 33 also has an inner ring 35 which serves to align gripping disk 23 when the push rod is moving outwardly as shown in FIG. 3. Outer ring 34 serves to stop inner end 30 of sheath member 25.

Sheath member 25 has an exterior shoulder 36 which, in the configuration shown in the drawings, is a curved cam surface identical in shape with the cam surface 37 on forward barrel 13. Cam surface 37 is also referred to herein as a first holding tube inner shoulder. The turning of the forward barrel with respect to sheath member 25 causes the relative longitudinal movement of sheath member 25 with respect to forward barrel 13. Forward barrel 13 has a locking ring 39 which tightly fits into locking recess 20 to hold locking ring 39 securely within lower barrel 11. It can also readily be seen that forward barrel 13, when inserted over sheath member 25, also holds the sheath member within lower barrel 11. The combined forward barrel and the lower barrel when combined are referred to herein as a holding tube assembly.

Figure 4:
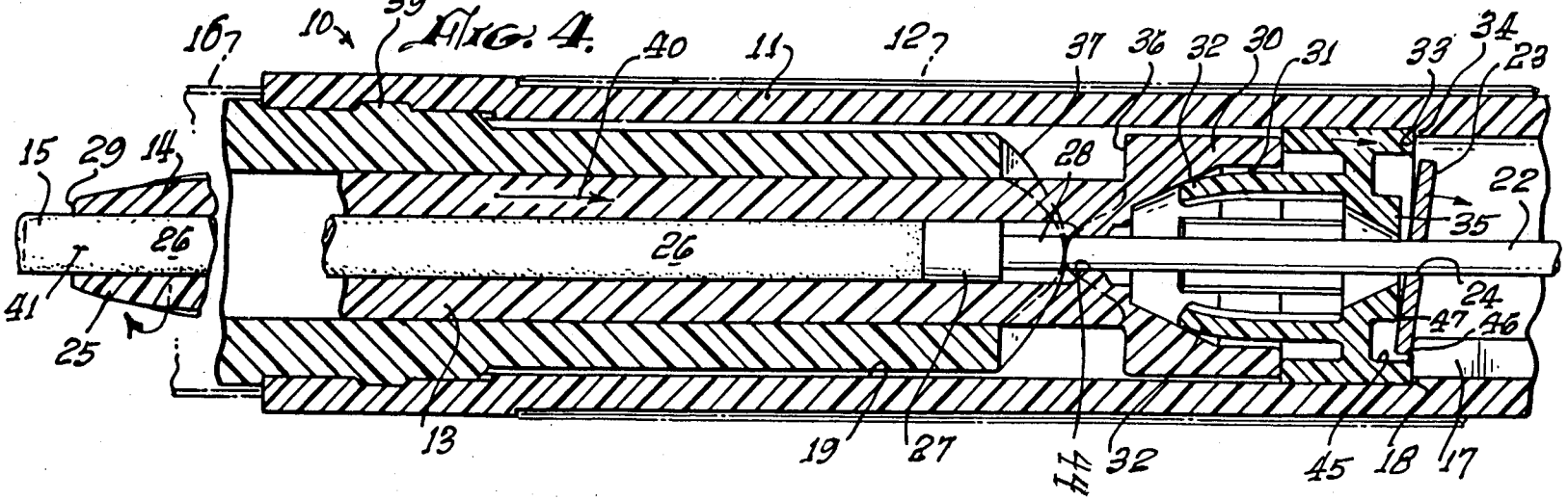
FIG. 4 is an enlarged cross-sectional view analogous to FIG. 3 with the spring in its compressed configuration.

The operation of the cosmetic pencil of FIGS. 1 through 4 is shown most clearly in FIGS. 3 and 4. In FIG. 3, the sheath 25 is in its maximum outward position with respect to forward barrel 13. The exterior shoulder 36 of sheath member 25 conforms to the cam surface 37 of forward barrel 13. Disk 23 is perpendicular to push rod 22 and push rod 22 is free to move outwardly therethrough. Disk 23 is held in that configuration by contact with inner ring 35 on gripping disk supporting member and spring element 33. In FIG. 4, the sheath has been turned with respect to the forward barrel, and the cam surface 37 is touching the shoulder 36 at only two points. The sheath has been moved inwardly in the direction of arrow 40 which causes disk 23 to push against stop element 17 moving it away from its right angle position of FIG. 3 and causes central opening 24 of disk 23 to bind against push rod 22 and hold it stationary with respect to forward barrel 13 and barrel 11 which, of course, results in the outward movement of a portion of crayon indicated by reference character 41. Note that the recessed area 45 in gripping disk supporting member and spring element 33 permits gripping disk 23 to be moved to its cocked configuration caused by its contact with stop element 17 and its point of contact 47 on the edge of recessed area 45.

At the same time the sheath has moved inwardly, the fingers 32 of gripping disk supporting member and spring element 33 have been bent inwardly by contact with frustro-conical surface 31. The inward movement of sheath member 25 is limited by contact with outer ring 34 of gripping disk supporting member and spring element 33. Because fingers 32 are flexible and stiff, they tend to push the sheath outwardly, back to the position shown in FIG. 3.

The turning of sheath 25 in forward barrel 13 may be facilitated by the addition of gripping ridges 42. It is also possible to operte the cosmetic pencil of the present invention by merely pushing inwardly on sheath 25 while holding either the barrel or forward barrel 13. This will also cause the same action as turning in that the inward movement causes disk 24 to be cocked to the positio shown in FIG. 4 and bind against push rod 22.

Figure 5:
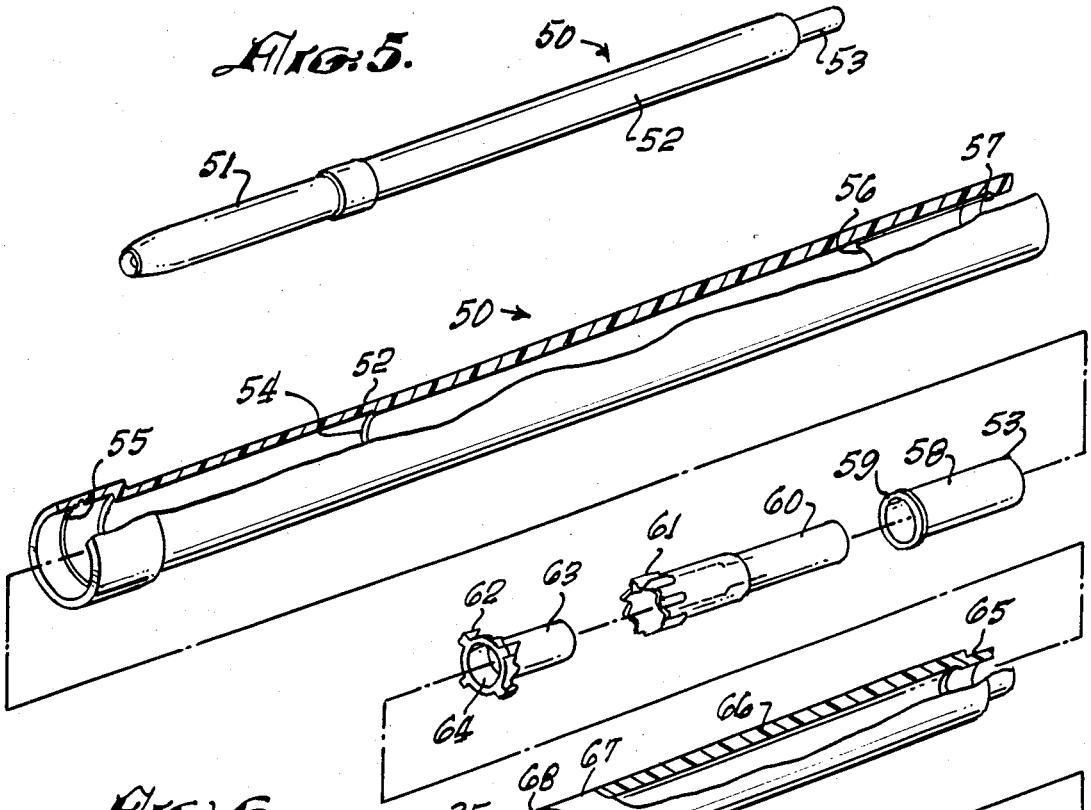
FIG. 5 is a perspective view of an alternate configuration of the cosmetic pencil of FIG. 1.
Figure 6:
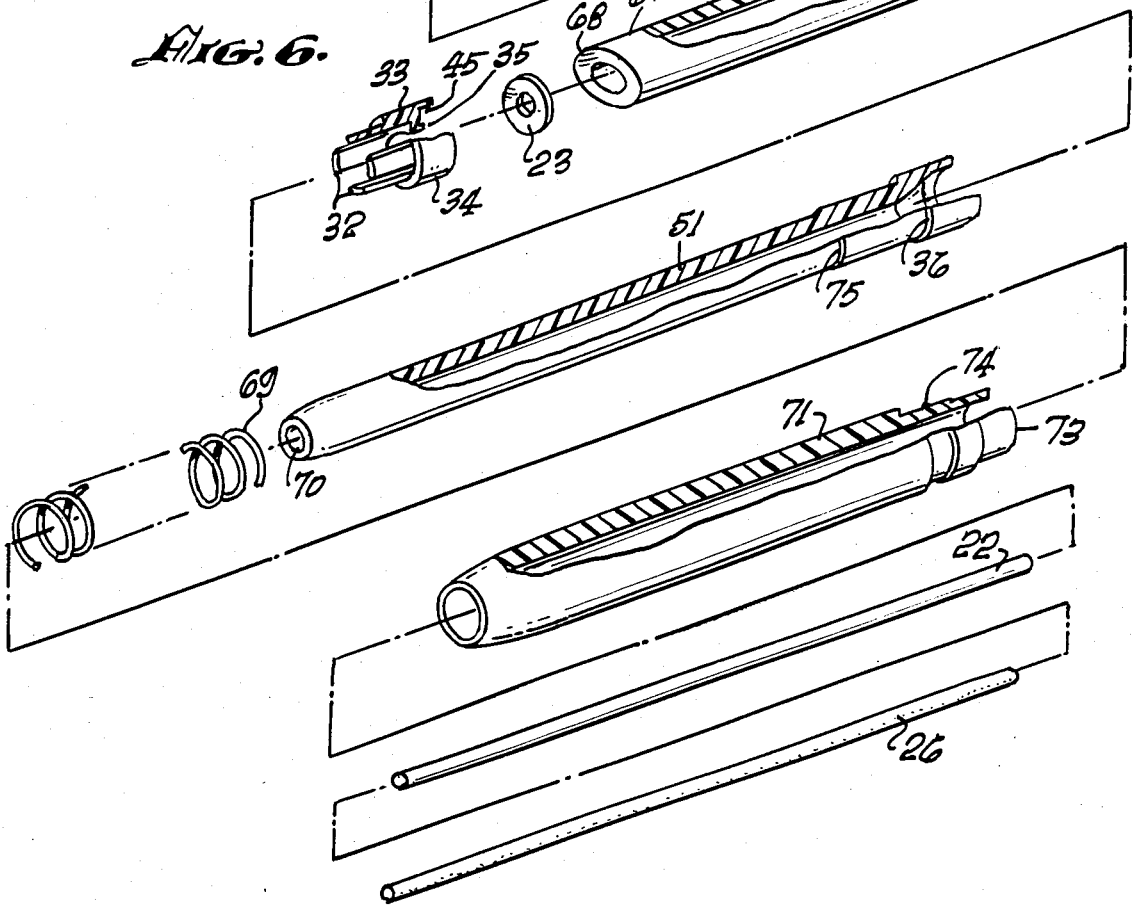
FIG. 6 is an exploded perspective view of the cosmetic pencil of FIG. 5.

A push button cosmetic pencil 50 is shown in perspective view in FIG. 5 and has a forward barrel 51, a rear barrel 52 and a push button 53. The construction of pencil 50 is shown in exploded view in FIG. 6. Rear barrel 52 has an internal forward shoulder 54, a lock groove 55 which holds the forward barrel as shown, a cam shoulder 56 and a rear shoulder 57. A push button assembly comprising a metal push button cap 58 has a rim 59 which abuts rear shoulder 57. A push button 60 has a plurality of protrusions 61 which cooperate both with cam shoulder 56 and with points 62 on rotater element 63. The inner surface 64 of rotater 63 forms a collar which fits loosely over recess 65 in the longitudinally moveable stop element member 66. The assembled member 66 and rear barrel 52 are referred to herein as an elongated lower cylindrical stop element assembly. Stop element member 66 has a hollow shaft 67 and an angled point 68. Point 68 contacts gripping disk 23 which, in turn, contacts spring means 33 in a manner analogous to that described above. It is important that a recessed area 45 be provided so that disk 23 may move into the area of the recess indicated at reference character 46 of FIG. 4. kSpring means 33 has fingers 32, an outer ring 34, an inner ring 35 and a recessed area 45. Although four fingers have been shown, it is possible that three, two or even one finger, or more than four, may be used. Sheath and push rod member 25 is described above and, briefly, has a frustro-conical surface 31 which contacts the fingers 32 of the gripping disk supporting member and spring element 33. A shoulder 36 serves as a base for helical spring 69. The axial cylindrical bore 70 of sheath 25 holds the push rod member 22 and the cosmetic mass 26 as described above. Forward barrel 71 has an axial bore 72 through which the sheath and push rod member 22 passes. An inner shoulder 73 contacts the forward end of helical spring 69, and lock ring 74 fits in lock groove 55 of rear barrel 52.

Figures 7, 8, 9:
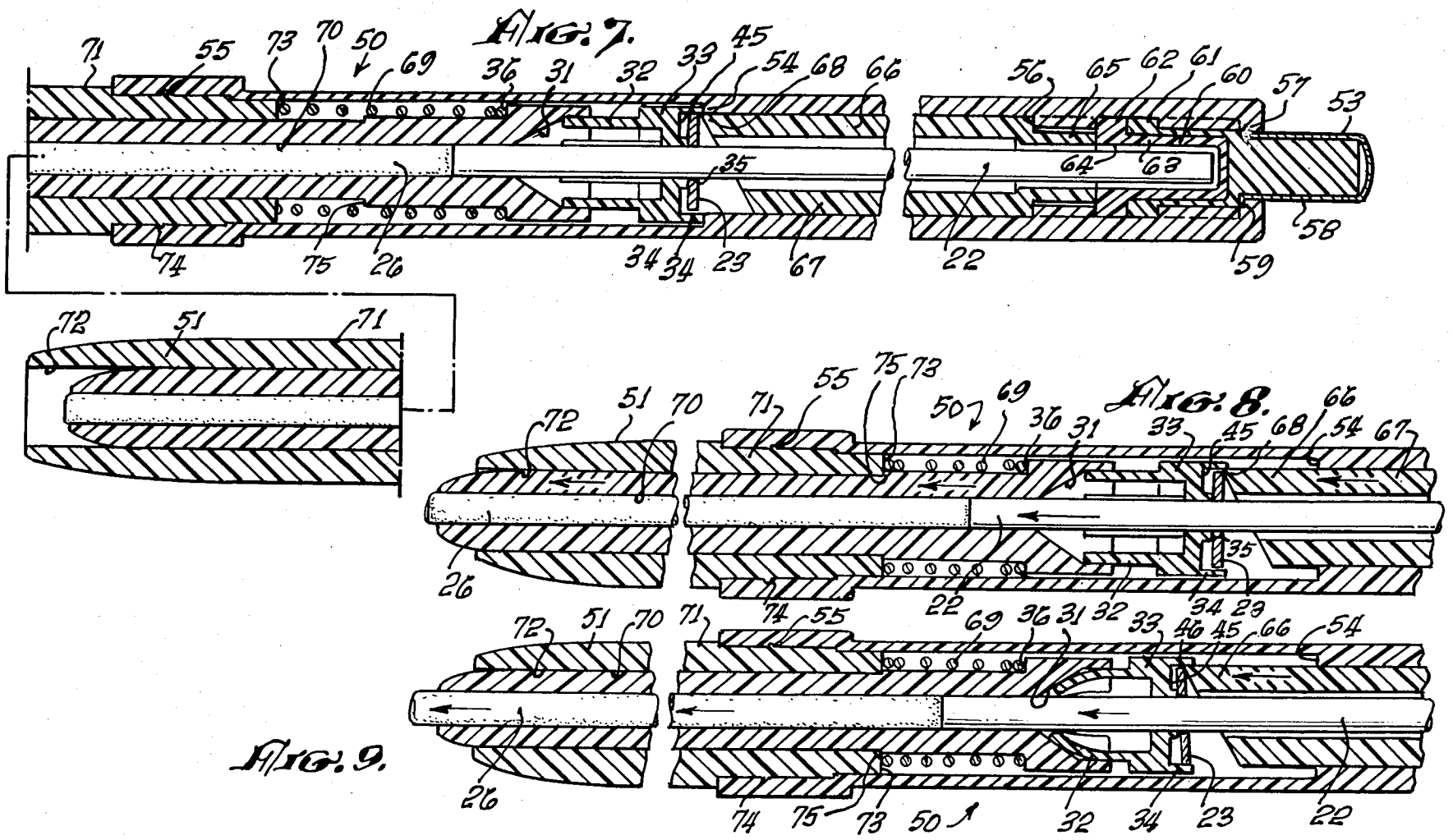
FIG. 7 is an enlarged cross-sectional view of the cosmetic pencil of FIG. 5.
FIG. 8 is a cross-sectional view of the cosmetic pencil of FIG. 5 showing the applicator end of the sheath projected.
FIG. 9 is a cross-sectional view of the cosmetic pencil of FIG. 5 showing both the applicator end of the sheath projected and further showing the cosmetic mass metered out from the tip.

The push button cosmetic pencil 50 functions both to eject the sheath and push rod member from within barrel 51, as shown in FIG. 5 and in FIG. 7, to an extended position as shown in FIGS. 8 and 9. Further pressure on the push button meters out a small amount of cosmetic mass 26 as shown in FIG. 9. This two-way action with a simple pushing of the push button results from the use of two different springs having different spring constants. Helical spring 69 is more readily compressed, and as push button cap 58 is depressed, a second shoulder 75 on sheath 25 contacts the inner shoulder 73 of forward barrel 71. It should be noted that the sheath and push rod member is moved outwardly by the combined force of the cocked disk 23 on the push rod member 22 together with the contact of the fingers 32 with the frustro-conical surface 31. These two forces readily depress helical spring 69 which need merely have a sufficient spring constant to retract the pencil when the push button is once again depressed. The action of the push button is conventional and, thus, is not described in detail herein. Further pushing on push button cap 58 compresses gripping disk supporting member and spring element 33 in a manner similar to that described with the cosmetic pencil of FIGS. 1 through 4. Fingers 32 are bent inwardly by contact with the frustro-conical surface 31, and the angled point 68 of stop element 66 moves gripping disk 23 to its cocked configuratio where it grips push rod member 22 ejecting a small metered amount of cosmetic mass 26.

It can be noted that the amount of cosmetic mass projected with a given depression of push button 60 is limited, unlike that occurring with a typical mechanical pencil where additional turning will eject additional pencil lead. The minimal ejection of cosmetic mass is highly beneficial and prevents, or at least reduces, the possibility of breaking off of the thin tip of soft mass.

The cosmetic pencil of the present invention has many advantages over prior art pencils. It is inexpensive to fabricate in that the lower barrel, the sheath, the spring element and the forward barrel may all be injectio molded. Of further importance is the ease of casting cosmetic mass within sheath member 25. The push head cylinder 27 need merely be inserted within the cylindrical opening 43 of sheath 25. A lower constrictio 44 holds cylinder 27 in place and the mass may be readily poured into the opening in melted form and allowed to harden. Thus, a minimum of labor is required in assembling the elements of the pencil of the present invention. It is also advantageous that the push rod be held at a point close to the bottom of the crayon or cosmetic mass in the event a relatively stiff mass is used or the pencil is permitted to get cold to further harden the mass. If the rod were pushed from the bottom and the mass were tightly cast in the opening of the sheath, a bending of the push rod could result which does not happen with the design of the present invention.

Although the device of the present invention has shown a novel spring element, the same results could be obtained with a conventional helical spring, a spring stop and a disk return alignment ring. The spring shown in the drawings, however, has the advantage of serving all these functions in one piece.

The present embodiments of this invention are thus to be considered in all respects as illustrative and not restrictive; the scope of the invention being indicated by the appended blaims rather than by the foregoing description. All changes which come within the meaning and range of equivalency of the claims are intended to be embraced therein.

What is claimed is:

1. A cosmetic pencil containing a cosmetic mass in a thin pencil lead-like configuratio having means for advancing the cosmetic mass comprising:

an elongated lower cylindrical stop element assembly having a hollow opening which has a disk stop element adjacent said opening;

a forward barrel having a hollow opening affixed to said elongated lower cylindrical stop element assembly and axially aligned therewith, said stop element assembly and said forward barrel forming a holding tube assembly;

a sheath and push-rod member having an elongated hollow sheath having an applicator end and an inner end and having an axial cylindrical bore therethrough, said bore being at least partially filled with a cosmetic mass and having a push-rod member having its inner terminus positioned within said bore and having its outer terminus extending outwardly past the inner end of said sheath, said sheath and push-rod member having a shoulder on the outer surface thereof near the inner end thereof, said sheath and push-rod member being held in said forward barrel so that the applicator end of the sheath is extendable outwardly of said forward barrel and the push rod member extends into the hollow opening of the holding tube assembly, said holding tube assembly having a first holding tube inner shoulder which surrounds the sheath and push rod member and stops the forward movement of the shoulder of the sheath and push rod member;

a gripping disk having a sheath facing side and a stop element facing side and having a central opening which has an inside diameter which is slightly larger than the outside diameter of said push rod member and said disk being positioned about the push rod member and said disk fitting within said holding tube assembly and abutting the disk stop element of the lower cylindrical stop element assembly near its outer edge;

a gripping disk supporting member adjacent the sheath facing side of said gripping disk and closely surrounding the push rod member, said gripping disk supporting member having an inner gripping disk supporting ring including a gripping disk supporting face adjacent to the push rod member and normal to the axis of the push rod member and an annular recess around the exterior of said gripping disk supporting ring extending from within the area adjacent the sheath facing side of said gripping disk and outwardly apst the outer periphery of said gripping disk; and spring means between said gripping disk supporting member and said sheath which urges said sheath toward the shoulder of the holding tube assembly, whereby when said sheath is moved inwardly with respect to said disk stop element, the gripping disk abuts the disk stop element of the lower cylindrical stop element assembly and an edge thereof moves into the recess of the disk supporting member and causes it to grip the push rod member so that the cosmetic mass is moved outwardly of said sheath at its applicator end.

2. The cosmetic pencil of claim 1 wherein said sheath has a generally frustro-conical opening axially positioned at the inner end with the base of the frustro-conical opening oriented toward the inner end of the sheath, and said spring means is integrally formed with said disk supporting member and has at least two flexible fingers which touch the inner surface of the frustro-conical opening whereby when the spring means is moved inwardly with respect to said sheath, the fingers are bent inwardly along the inner surface of the frustro-conical opening and urges the sheath outwardly of said barrel.

3. The cosmetic pencil of claim 2 wherein said gripping disk supporting member has an outer ring having a rearward facing surface and a forward facing surface, the rearward facing surface abuts a second holding tube inner shoulder in the elongated lower cylindrical stop element assembly and the forward facing surface thereof abuts the inner end of the sheth when the spring means has been moved inwardly with respect to said sheath.

4. The cosmetic pencil of claim 2 wherein said spring means has four fingers.

5. The cosmetic pencil of claim 1 wherein the shoulder on the outer surface of the sheath has a curved cam surface and the first holding tube inner shoulder has a cam follower thereon, whereby the turning of the sheath with respect to the holding tube assembly causes the sheath to move inwardly and outwardly in said holding tube assembly and for the push rod member to move in an outward direction in said sheath urging a small amount of the cosmetic mass to be ejected from the applicator end of the sheath.

6. The cosmetic pencil of claim 1 wherein the elongated lower cylindrical stop element assembly has a longitudinally moveable stop element which is operated by a push button positioned at the back end of the holding tube assembly.

7. A cosmetic pencil containing a cosmetic mass in a thin pencil lead-like configuration having means for advancing the cosmetic mass comprising:

an elongated lower cylindrical member having a hollow opening which has a disk stop element adjacent its inner surface;

a sheath and push rod member having an elongated hollow sheath having an applicator end and an inner end and having an axial cylindrical bore therethrough, said bore being at least partially filled with a cosmetic mass and having a push rod member having its inner terminus positioned within said bore and having its outer terminus extending outwardly past the inner end of said sheath, said sheath and push rod member having a shoulder on the outer surface thereof, said sheath and push rod member being held in said lower cylindrical member so that the applicator end of the sheath extends outwardly of said lower cylindrical member and the push rod extends into the hollow opening of the lower cylindrical member;

a gripping disk having a sheath facing side and a stop element facing side having a central opening which has an inside diameter which is slightly larger than the outside diameter of said push-rod member and said disk fitting within the hollow opening of the lower cylindrical member, said gripping disk being positioned about the push rod member and abutting the disk stop element of the lowr cylindrical member near its outer edge;

a holding tube having an axial opening which surrounds the sheath and push rod member near its applicator end, said holding tube having an inner end which extends into the lower cylindrical member and said holding tube having a first holding tube inner shoulder which abuts the shoulder of the sheth and said holding tube being affixed to said lower cylindrical member so that the outer end thereof extends outwardly of said lower cylindrical member;

a gripping disk supporting member adjacent the sheath facing side of said gripping disk and closely surrounding the push rod member, said gripping disk supporting member having an inner gripping disk supporting ring including a gripping disk supporting face adjacent to the push rod member and normal to the axis of the push rod member and an annular recess around the exterior of said gripping disk supporting ring extending from within the area adjacent the sheath facing side of said gripping disk and outwardly past the outer periphery of said gripping disk; and spring means between said disk supporting member and said sheath which urges the sheath outwardly with respect to the holding tube and which pushes said gripping disk support member inwardly and the gripping disk supporting face abuts said gripping disk near the central opening of said gripping disk, whereby when said sheath is moved inwardly of said lower cylindrical member, the gripping disk abuts the disk stop element of the lower cylindrical member near th eouter edge of the gripping disk which thereby tips and its central opening grips the push rod holding it stationary so that the cosmetic mass is moved outwardly of said sheath at its applicator end.

8. The cosmetic pencil of claim 7 further including a cam surface on the first inner holding tube shoulder of said holding tube and a cam follower on the shoulder of the sheath.

9. The cosmetic pencil of claim 7 further including an enlarged portion on the end of the push rod member operating as a push head cylinder positioned within said bore of said sheath and abutting the inner terminus of the push rod member.

10. A cosmetic pencil containing a cosmetic mass in a thin pencil lead-like configuration having means for advancing the cosmetic mass comprising:

an elongated lower cylindrical stop element assembly including an axially positioned longitudinally moveable and hollow stop element member which has a disk stop element positioned on its inner terminus;

a forward barrel having a hollow opening affixed to said elongated lower cylindrical stop element assembly and axially aligned therewith, said stop element assembly and said forward barrel forming a holding tube assembly;

a sheath and push rod member having an elongated hollow sheath having an applicator end and an inner end and having an axial cylindrical bore therethrough, said bore being at least partially filled with a cosmetic mass and having a push rod member having its inner terminus positioed within said bore and having its outer terminus extending outwardly past the inner end of said sheath, said sheath and push rod member having a shoulder on th eouter surface thereof near the inner end thereof, said sheath and push rod member being held in said forward barrel so that the applicator end of the sheath is extendable outwardly of said forward barrel, and the push rod member extends outwardly from the sheath and into the hollow opening of the hollow stop element member, said holding tube assembly having a first holding tube inner shoulder which surrounds the sheath and push rod member and stops the forward movement of the shoulder of the sheath and push rod member;

a gripping disk having a sheath facing side and a stop element facing side and having a central opening which has an inside diameter which is slightly larger than the outside diameter of said push rod member and said disk being positioned about the push rod member and said disk fitting within said holding tube assembly and abutting the disk stop element of the lower cylindrical stop element assembly near the outer edge of the disk;

a gripping disk supporting member adjacent the sheath facing side of said gripping disk and closely surrounding the push rod member, said gripping disk supporting member having an inner gripping disk supporting ring including a gripping disk supporting face adjacent to the push rod member and normal to the axis of the push rod member and an annular recess around the exterior of said gripping disk supporting ring extending from within the area adjacent the sheath facing side of said gripping disk and outwardly past the outer periphery of said gripping disk; and first spring means positioned at the inner end of the sheath portion of the sheath and push rod member which urges the shoulder of said sheath toward the first holding tube inner shouldelr;

second spring means held between the first holding tube inner shoulder of the forward barrel and the shoulder on th eouter surface of the sheath, said second spring means having a lower spring constant than the first spring means so that the sheath is moved outwardly of said forward barrel before any additional cosmetic mass is metered out of the sheath; and disk stop element depressing means held at the rearward end of the cosmetic pencil adapted to move the stop element inwardly whereby when said disk stop element is moved inwardly with respect to the sheath, the gripping disk abuts the disk stop element member and causes it to grip the push rod so that the cosmetic mass is moved outwardly of said sheath at its applicator end.

11. The cosmetic pencil of claim 10 wherein said disk stop element depressing means comprises a push button.

12. The cosmetic pencil of claim 10 wherein said first spring means is positioned at the inner end of said sheath and surrounds said push rod member.

13. The cosmetic pencil of claim 12 wherein said sheath has a generally frustro-conical opening axially positioned at the inner end with the base of the frustro-conical opening oriented toward the inner end of the sheath, and said first spring means is integral with said gripping disk supporting member, said gripping disk supporting member having an outer ring which abuts a second holding tube inner shoulder of the elongated lower cylindrical stop element assembly and said first spring means has at least one flexible finger which touches the inner surface of the frustro-conical opening whereby when the first spring means is moved inwardly with respect to said sheath the finger is bent inwardly along the inner surface of the frustro-conical opening and urges the sheath outwardly of said barrel.

14. The cosmetic pencil of claim 13 wherein said outer ring of said gripping disk supporting member has an outside diameter slightly less than the inside diameter of the lower cylindrical stop element assembly whereby the gripping disk supporting member is kept in axial alignment in the lower cylindrical stop element assembly.

15. The cosmetic pencil of claim 14 wherein said first spring means has a plurality of fingers.

16. The cosmetic pencil of claim 15 wherein said spring element has four fingers.

17. The cosmetic pencil of claim 10 wherein said second spring means is a helical spring.

* * * * *